US010207382B2

(12) United States Patent
Marty et al.

(10) Patent No.: US 10,207,382 B2
(45) Date of Patent: Feb. 19, 2019

(54) GRINDING MACHINE AND METHOD FOR MACHINING A WORKPIECE

(71) Applicant: Rollomatic SA, La Landeron (CH)

(72) Inventors: Jean-Charles Marty, La Neuveville (CH); David Bissat, Mur (CH)

(73) Assignee: Rollomatic SA (CH)

( * ) Notice: Subject to any disclaimer, the term of this patent is extended or adjusted under 35 U.S.C. 154(b) by 38 days.

(21) Appl. No.: 15/309,731

(22) PCT Filed: Jul. 13, 2015

(86) PCT No.: PCT/EP2015/065974
§ 371 (c)(1),
(2) Date: Nov. 8, 2016

(87) PCT Pub. No.: WO2017/008836
PCT Pub. Date: Jan. 19, 2017

(65) Prior Publication Data

US 2017/0182613 A1 Jun. 29, 2017

(51) Int. Cl.
*B24B 5/16* (2006.01)
*B24B 5/26* (2006.01)

(52) U.S. Cl.
CPC . *B24B 5/16* (2013.01); *B24B 5/26* (2013.01)

(58) Field of Classification Search
CPC ..... B24B 5/16; B24B 5/26
USPC ..... 451/28, 49, 5, 8–10, 245, 57, 58
See application file for complete search history.

(56) References Cited

U.S. PATENT DOCUMENTS 5,865,667 A * 2/1999 Rollier ..... B24B 1/00 451/11
6,394,880 B1 * 5/2002 Basler ..... A61C 13/0003 451/28
2011/0195635 A1 8/2011 Himmelsbach

FOREIGN PATENT DOCUMENTS

| | | | |
|---|---|---|---|
| CN | 103100950 | A | 5/2013 |
| DE | 102008061528 | A1 | 6/2010 |
| EP | 0999011 | A1 | 5/2000 |
| EP | 2263830 | A2 | 12/2010 |
| JP | S-63102864 | A | 5/1988 |
| JP | 2005028556 | A | 2/2005 |

OTHER PUBLICATIONS

International Search Report and Written Opinion of PCT/EP2015/065974, dated Mar. 17, 2016, 6 pages.

* cited by examiner

*Primary Examiner* — Robert Rose
(74) *Attorney, Agent, or Firm* — Blank Rome LLP

(57) ABSTRACT

The invention concerns a method for machining a workpiece (1) by a grinding machine, comprising the step of rotating and translating the workpiece along a first axis (4) toward the first abrasive wheel; rotating an abrasive wheel (6) around a second axis (61) and translating it along a third axis (62) such that the abrasive wheel grinds a peripheral portion (103) of the workpiece; the abrasive wheel being positioned in a position in translation along the third axis; and wherein the position in translation is determined as a function of a position and of an angular position of the workpiece around the first axis. The invention further related to a grinding machine for carrying out such method.

19 Claims, 9 Drawing Sheets

GRINDING MACHINE AND METHOD FOR MACHINING A WORKPIECE

RELATED APPLICATIONS

This application is a national phase of PCT/EP2015/065974, filed on Jul. 13, 2015. The content of the application is hereby incorporated by reference.

FIELD OF THE INVENTION

The present invention concerns a grinding machine and a method for machining a workpiece, in particular small workpiece.

DESCRIPTION OF RELATED ART

There is a need for reliable and cost-effective means for producing complex profiled workpieces or tools by machining raw monoblocs.

Profile grinding machines are often used for the grinding of workpieces having complex profiles with a plurality of straight and/or curved parallel or mutually inclined surfaces or facets, shoulders, recesses, grooves, protuberances and/or other irregularities. When using a profile grinding machine, the profile which has to be ground is successively ground during a roughing operation with a roughing grinding tool and is afterwards ground during a finishing operation with a finishing grinding tool. When using an optical profile grinding machine operating with a projecting system, the environment of machining is projected in magnification onto a picture screen by means of an optical system, where the silhouette of the work piece and the machining tool can be compared to the drawing of the work piece put onto the picture screen on transparent paper. However, using a profile grinding machine (or an optical profile grinding machine) requires a permanent survey by a specialist as well as successive corrections of the machining parameters in order to obtain the desired longitudinal and cross section shapes, notably during the setup of the grinding procedure. Moreover, such grinding machines are unsuitable to grind workpieces having longitudinal contours with negative slopes with respect to the longitudinal direction of the grinding operations.

Document US2011195635 discloses a grinding machine arranged to retain the extremities of a plurality of workpieces so to grind theirs free surfaces by a couple of radially movable grindstones. The grindstones are dimensioned so to grind simultaneously the entire longitudinal contour of the workpiece. A rotation of the workpieces at successive predefined angular positions allows the machining of workpieces having non-round cross-sections. Workpieces having conical or rounded longitudinal contour could be machined by equipping the grinding machine with grindstones having a corresponding, complementary abrasive profile. However, this grinding machine can machine uniquely cylindrical-shaped raw workpieces having opposite, parallel end faces, in particular having a cross section edge of 2-15 mm and a length of 10-80 mm.

Document DE102008061528 discloses a machining method for grinding a plurality of cams within a camshaft. A couple of different sized grindstones are thus successively placed in front of each cam of the camshaft. While the camshaft is placed in rotation, the grindstones are moved radially in function of the angular position of the cam so to grind simultaneously the entire longitudinal contour the cam. However, the disclosed machining method is destined to machine workpieces having only longitudinal contours parallel with respect to the rotational axis of workpiece. Moreover, the machining method is only suitable to operate on workpiece having a concave surface with a radius between 35 and 150 mm.

Document U.S. Pat. No. 5,865,667 discloses a grinding machine arranged to retain and move an end of a workpiece while grinding the free end of the workpiece by a couple of grindstones. While the workpiece is placed in rotation and translated axially, the grindstones are translated towards the workpiece in function of the axially position of the free portion of the workpiece so to varying locally the cross diameter of the workpiece. However, this grinding machine can only machine round-shaped workpieces.

BRIEF SUMMARY OF THE INVENTION

The aim of the invention is to provide a grinding machine and a machining method exempt of (at least parts of) the limitations of known grinding machines and machining methods.

According to the invention, this aim is achieved by means and the grinding machine.

An advantage of the present solution is to provide a more reliable and economical machining of workpieces having non-round cross-sections with respect of the solutions of the prior art. In particular, the present solution provides a reliable and economical machining of elongated workpieces having a non-round portion with a small cross section.

Another advantage of the present solution is to provide a more reliable and economical machining of workpieces having non-parallel longitudinal contours, in particular having at least a portion with a longitudinal concave contour, with respect of the known solutions.

Moreover, this solution further provides a reliable and economical machining of elongated workpieces having an off-centred terminal portion with a small cross section, with respect to prior art grinding machines and machining methods. In particular, the claimed solution provides a reliable and economical machining of small, elongated workpieces having an off-centred terminal portion or a non-round cross-section with a plurality of concave/convex contours.

BRIEF DESCRIPTION OF THE DRAWINGS

The invention will be better understood with the aid of the description of embodiments given by way of example and illustrated by the figures, in which.

DETAILED DESCRIPTION OF POSSIBLE EMBODIMENTS OF THE INVENTION

Figure 1:
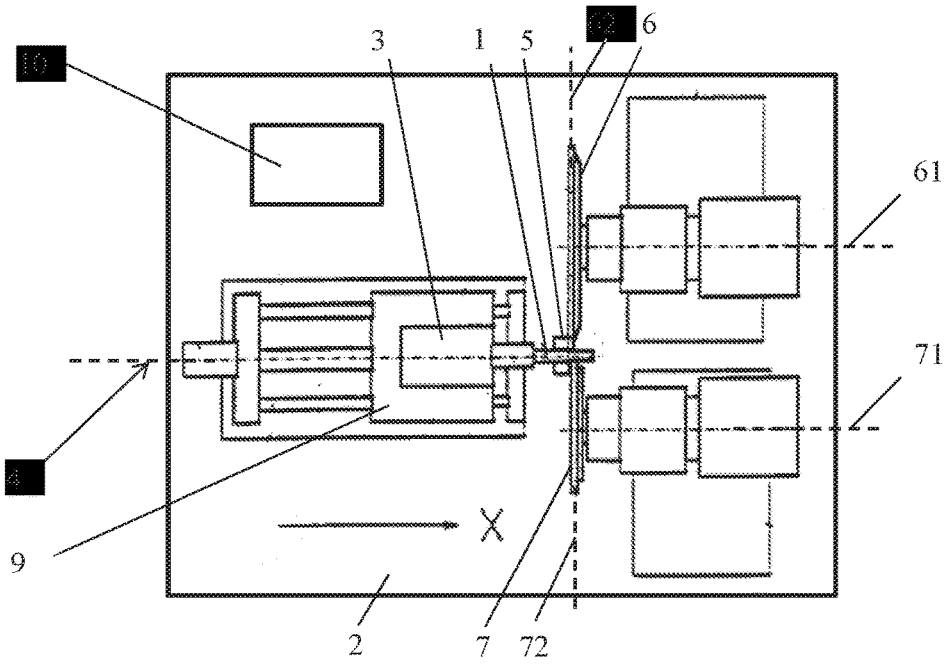
FIG. 1 shows a view of a grinding machine according to the invention.
Figure 2:
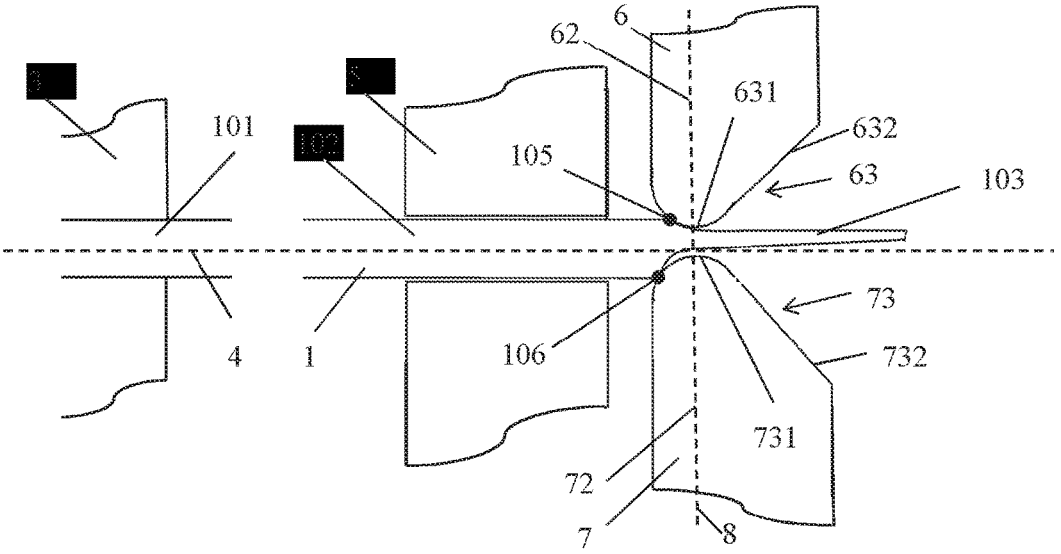
FIG. 2 is a detailed illustration of parts of the grinding machine of FIG. 1.

FIGS. 1 and 2 show a grinding machine for machining a workpiece 1, according to the invention. The grinding machine comprises a spindle 3 arranged for grasping one end 101 of the workpiece 1 such that the workpiece 1 can be rotated around and translated along a first axis 4 when grasped by the spindle 3. The spindle 3 can be a rotatable spindle arranged to rotate around the first axis 4. The spindle can thus be mounted on a headstock 9 that is movable with respect to a framework 2 of the grinding machine along the first axis 4.

The workpiece 1 can be a raw cylindrical-shaped monobloc of any grindable material including for instance a metal, an alloy, or a ceramic.

The grinding machine further comprises a guiding support 5 spaced distally from the spindle 3 along the first axis 4. The guiding support provides a slidingly support of the other end 102 of the workpiece 1, i.e. the guiding support is arranged to impede a substantially radially movement of the other end 102 with respect to the first axis 4. The guiding support 5 can be directly fixed to the framework 2 of the grinding machine. The spindle 3, the headstock 9 and/or the guiding support 5 can be equipped with aligning means providing a manual, a semi-automatic or a fully automatically alignment of such components along the first axis.

The grinding machine further comprises a first abrasive wheel 6 arranged to rotate around a second axis 61 and to translate along a third axis 62 oblique or perpendicular to the second axis 61, such as to grind a peripheral portion 103 of the workpiece 1.

The abrasive wheel can be any type of disc- or cylindrical-shaped tool having an operational abrasive profile destined to machine a surface of a workpiece, e.g. a round sharpened stone or a grindstone.

In an embodiment, the grinding machine further comprises a second abrasive wheel 7 arranged to rotate around a fourth axis 71 and to translate along a fifth axis 72 oblique or perpendicular to the fourth axis 71, such as to grind a peripheral portion of the workpiece 1.

The first and the second abrasive wheels 6, 7 have an abrasive profile 63, 73, i.e, a radial portion of the abrasive wheel suitable to machine a surface of a workpiece, comprising a first rounded portion 631, 731 and a second substantially flat portion 632, 732.

Depending on the typology of the machining, the first and second abrasive wheel 6, 7 can have the same dimensions or have different dimensions (such as sizes, rounded portions, flat portions, etc.). Moreover, the first and second abrasive wheel 6, 7 can have the same or different abrasive features (such as abrasive materials, surface treatments, etc).

In a preferred embodiment, the grinding machine is a computerized numerical controlled grinding machine (CNC grinding machine). The grinding machine can thus comprise a programmable digital control apparatus 10 in order to allow for a semi- and/or a fully automatically machining of the workpiece. The apparatus 10 can be arranged to acquire and process machining technical specifications or digital models of workpieces in order to drive and control operations and movements of the various components of the grinding machine, in particular the translation and the rotation of the workpiece 1 and the translation of the first and second abrasive wheels 6, 7.

Figure 3:
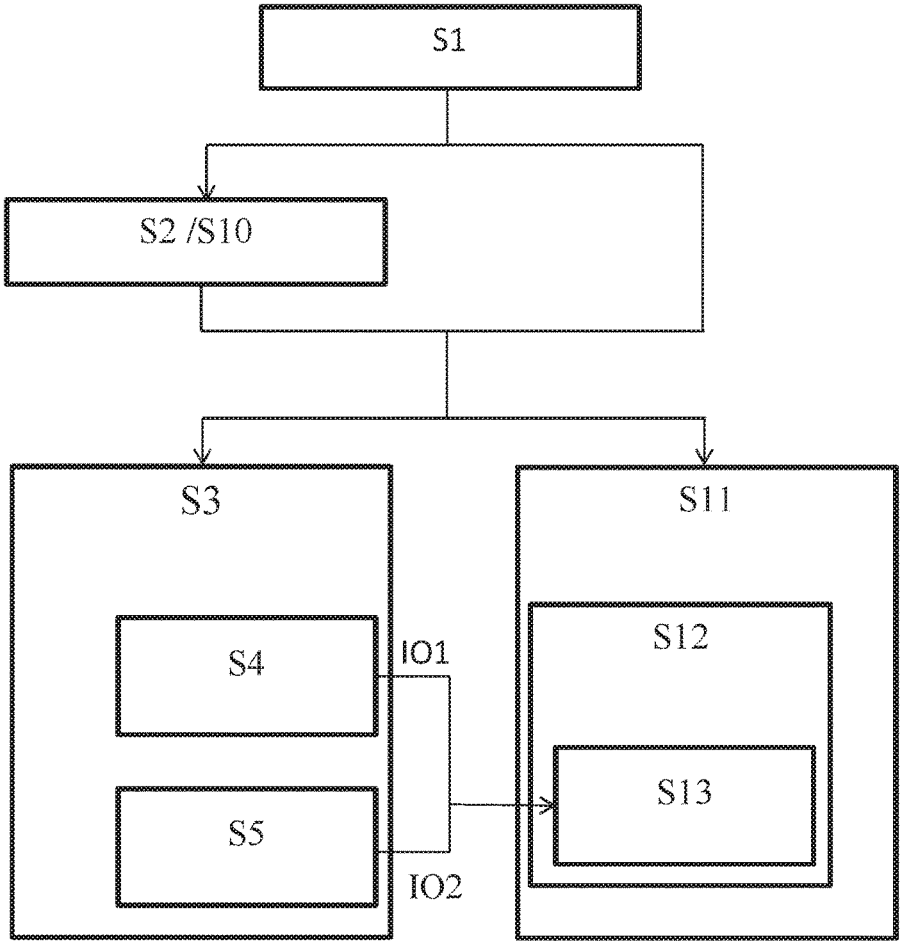
FIG. 3 illustrates a flow diagram of a first embodiment of a method for machining a workpiece, according to the invention.

According to an embodiment schematically represented in FIG. 3, a method for machining the workpiece 1 by using the grinding machine comprises a step (S1 in FIG. 3) of grasping one end 101 of the workpiece 1 in the spindle 3 such that the other end 102 of the workpiece is supported in the guiding support 5.

The method further comprises the step of positioning the workpiece 1 in a predefined position (S2). The predefined position can be defined with respect to the framework 2, guiding support 5 and/or with respect to a 3D coordinate system of the grinding machine. The support guide 5 can be used as centre of this coordinate system. The step of positioning (S2) can involve a translation and/or a rotation of the workpiece 2 along/around the first axis 4, for example by means of the spindle 5 and/or the headstock 9.

The method can further comprise a step (S10) of positioning the first abrasive wheel 6 in a predefined position with respect to the framework 2, the guiding support 5 and/or with respect to a 3D coordinate system of the grinding machine. Advantageously, the grinding profile 63 of the first abrasive wheel 6 is operationally positioned as close as possible to the guiding support 5 so to be able to machine the portion of the workpiece 1 that extends from the guiding support 5 in a direction substantially opposite from the spindle 5. The step (S10) of positioning the first abrasive wheel 6 in a predefined position can be executed simultaneously, prior or after the step (S2) of the positioning of the workpiece.

In a further step (S3), the workpiece 1 is rotated by the spindle 5 and possibly moved in translation along the first axis 4 toward the guiding support 5. The translation movement will cause the workpiece to further extend distally from the guiding support 5. The workpiece 1 is be rotated at a predefined rotational speed or at a variable rotational speed. The translation movement can also be performed at a predefined translation speed or at a variable translation speed.

In a further step (S11), the first abrasive wheel 6 is rotated around the second axis 61 and possibly moved in translation along the third axis 62 such as to machine (grind) a peripheral portion 103 of the workpiece 1 that extends distally from the guiding support 5 and comes into contact with the first abrasive wheel 6.

In an embodiment, the translation movement of the first abrasive wheel 6 is performed in successive positioning of the first abrasive wheel along the third axis 62 (S12). Each position of the first abrasive wheel 6 can then be determined as a function of a position of the workpiece 1 along the first axis 4, and an angular position of the workpiece 1 around the first axis 4 (S13).

Figure 4:
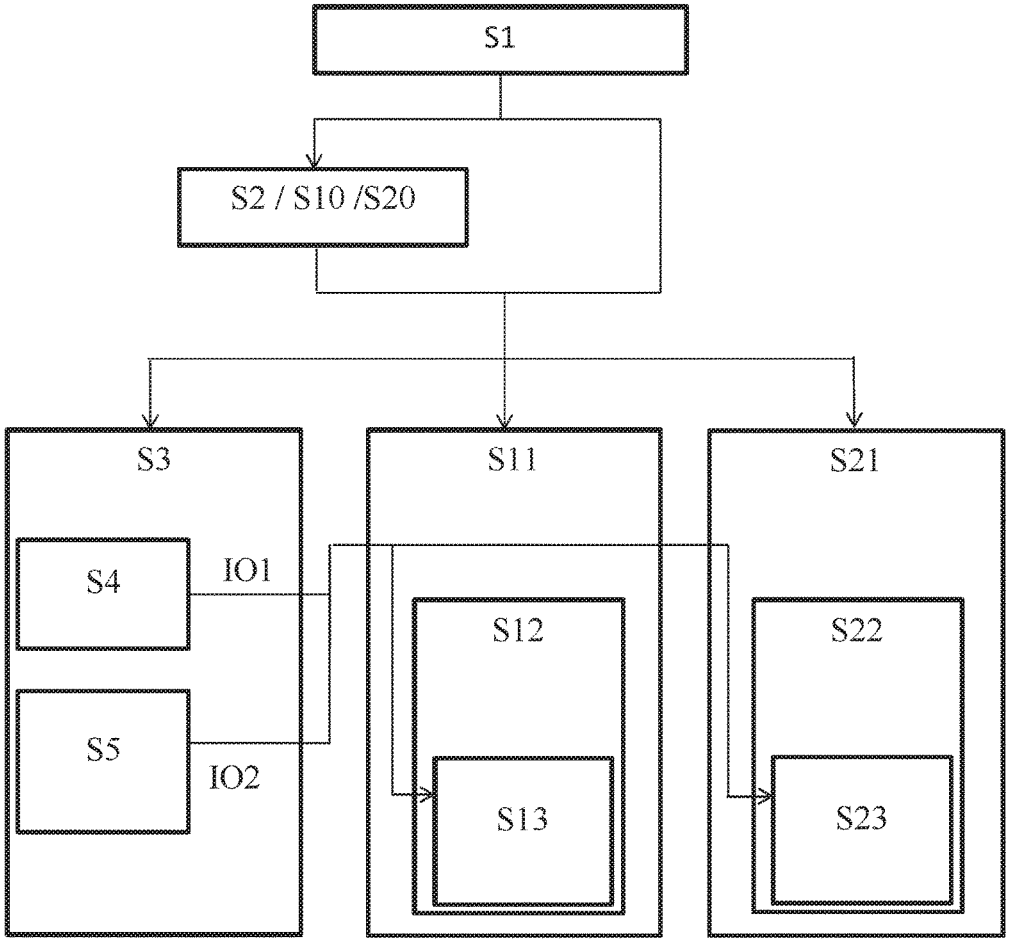
FIG. 4 illustrates a flow diagram of a second embodiment of a method for machining a workpiece, according to the invention.

In a preferred embodiment illustrated in FIG. 4, the grinding machine comprises the second abrasive wheel 7 and the method further comprises a step (S21) of rotating the second abrasive wheel 7 around the fourth axis 71, and possibly moved in translation along the fifth axis 72 such as to machine (grind) a peripheral portion 103 of the workpiece 1 that extends distally from the guiding support 5 and comes into contact with the second abrasive wheel 7.

The method can further comprise a step (S20) of positioning the second abrasive wheel 7 in a predefined position with respect to the framework 2, the guiding support 5 and/or with respect to a 3D coordinate system of the grinding machine. Advantageously, the grinding profile 73 of the second abrasive wheel 7 is operationally positioned as close as possible to the guiding support 5 so to be able to machine the portion of the workpiece 1 that extends from the guiding support 5 in a direction substantially opposite from the spindle 5. The step (S20) of positioning the second abrasive wheel 7 in a predefined position can be executed simultaneously, prior or after the step (S2) of the positioning of the workpiece.

In an embodiment, the translation movement of the second abrasive wheel 7 is performed in successive positioning of the second abrasive wheel 7 along the fifth axis 72(S22). Each position of the second abrasive wheel 7 can then be determined as a function of a position of the workpiece 1 along the first axis 4, and an angular position of the workpiece 1 around the first axis 4 (S23).

Rotating and translating the second abrasive wheel 7 (S21) can be executed simultaneously with rotating and translating the workpiece (S3) and with rotating and translating the first abrasive wheel 6 (S11).

Each position of the second abrasive wheel 7 (Step S23) can be determined as a function of a position of the workpiece 1 along the first axis 4, and an angular position of the workpiece 1 around the first axis 4.

Depending on the typology of the machining operation, the first abrasive wheel 6 and the second abrasive wheel 7 can be arranged to grind substantially the same peripheral portion 103 of the workpiece 1 at two distinct surface portions 105, 106. Moreover, the abrasive wheels 6, 7 can further be arranged to operate simultaneously on the same peripheral portion 103.

Advantageously, the position of the workpiece 1 used for the determination of a position of the first abrasive wheel 6 (S13) is the same position of the workpiece 1 used for the determination of a position of the second abrasive wheel 7 (S23).

The position of the workpiece 1 used for the determination of a position of the first and/or second abrasive wheel 6, 7 can be a relative position of the workpiece 1 along the first axis 4 with respect to the framework 2, the guiding support 5, the first and/or second abrasive wheel 6, 7 and/or with respect to the 3D coordinate system of the grinding machine.

The position of the workpiece 1 used for the determination of a position of the first and/or second abrasive wheel 6, 7 can further be determined by a position of the spindle 3 and/or of the headstock 9 along the first axis 4.

The position of the workpiece 1 used for the determination of a position of the first and/or second abrasive wheel 6, 7 can be a position of the workpiece 1 at the time of a determination of a next positioning of the first and second abrasive wheel 6, 7.

Alternatively, the position of the workpiece 1 used for the determination of a position of the first and/or second abrasive wheel 6, 7 can be a position of the workpiece 1 estimated (e.g. calculated by program executed by the programmable digital control apparatus 10) at a time when a next translation of the first and/or second abrasive wheel 6, 7 is planned or executed.

Figure 5:
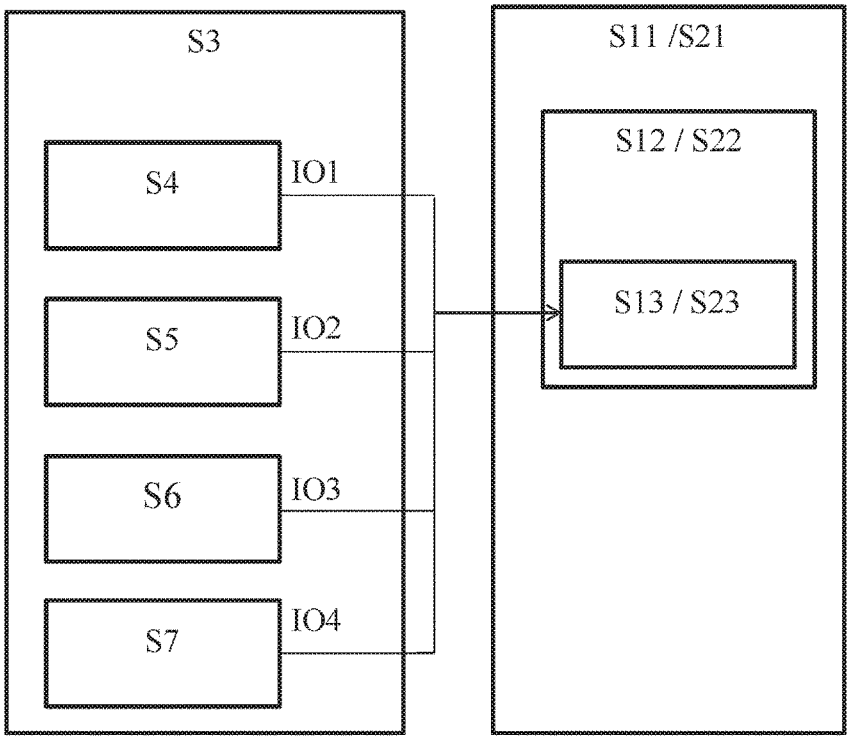
FIG. 5 illustrates a relationship between the movements of the workpiece and the abrasive wheel(s), according to the invention.

FIG. 5 shows some details of a preferred embodiment of the method. In this embodiment, the determination of the next positioning of the first and/or second abrasive wheel 6, 7 (step S13 and/or 23) is a function of the predefined or variable translation speed of the workpiece 1. The determination of the next positioning of the first and/or second abrasive wheel 6, 7 can, for example, take into account a speed value at the time of the determination of the next positioning, a speed value estimated at the time of the planned next translation of the first and/or second abrasive wheel 6, 7 and/or an interpolation of such speed values.

The translation speed of the workpiece 1 used for the determination of a position of the first and/or second abrasive wheel 6, 7 (S13, S23) can be a relative speed of the workpiece 1 along said first axis 4 with respect to the framework 2, the guiding support 5, the first and/or second abrasive wheel 6, 7 and/or with respect to the 3D coordinate system of the grinding machine.

The translation speed of the workpiece 1 used for the determination of a position of the first and/or second abrasive wheel 6, 7 can also be estimated (e.g. calculated by program executed by the programmable digital control apparatus 10) by a translation speed of the spindle 3 and/or of the headstock 9 along the first axis 4.

The angular position of the workpiece 1 used for the determination of a position of the first abrasive wheel 6 can be the same as the angular position of the workpiece 1 used for the determination of a position of the second abrasive wheel 7 (S23).

The angular position of the workpiece 1 used for the determination of a position of the first and/or second abrasive wheel 6. 7 can be an angular position of the workpiece 1 at a time of a determination of a next position of the first and/or the second abrasive wheel 6, 7.

Alternatively, the angular position of the workpiece 1 used for the determination of a position of the first and/or second abrasive wheel 6, 7 can be estimated (e.g. calculated by program executed by the programmable digital control apparatus 10) angular position of the workpiece 1 at a time when a next translation of the first and/or the second abrasive wheel 6, 7 will be planned or executed.

The angular position used for the determination of a position of the first and/or second abrasive wheel 6, 7 can be a relative angular position of the workpiece 1 with respect to the framework 2, the guiding support 5, the first and/or second abrasive wheels 6, 7 and/or with respect to the 3D coordinate system of the grinding machine.

The angular position of the workpiece 1 used for the determination of a position of the first and/or second abrasive wheel can be derived or eventually be substituted by an angular position of the spindle 3 around the first axis 4.

Advantageously, the determination of the next position of the first and/or second abrasive wheel 6, 7 (S13, S23) can be a function of the predefined or variable angular speed of the workpiece 1, as illustrated in FIG. 5.

The determination of the next position of the first and/or second abrasive wheel 6, 7 can, for example, take into account an angular speed value at the time of the determination of the next position, a foreseen angular speed value at the time of the planned next translation of the first and/or second abrasive wheel and/or an interpolation of such angular speed values.

Figure 6:
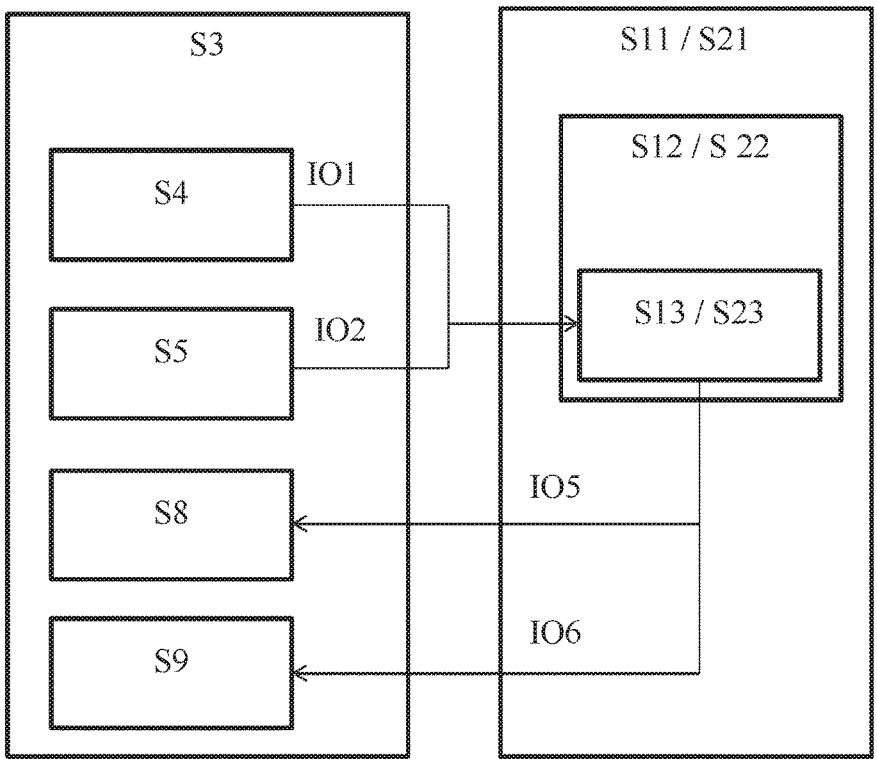
FIG. 6 illustrates a variant of the relationship between the movements of the workpiece and the abrasive wheel(s), according to the invention.

FIG. 6 shows a particular advantageously embodiment of the method. In this embodiment, in order to take into account technical and physical limitations of the grinding machine components, of workpieces material and dimension and/or of the typology of the machining operation, the step of determination of the next position of the first and/or second abrasive wheel 6, 7 (S13, S23) comprises a step of selecting a translation speed 105 and/or a variable angular speed 106 of the workpiece 1. The translation speed and/or a variable angular speed of the workpiece 1 are then modified according to the selected translation and/or rotational speed (steps S8 and S9).

Preferably, during the step S3, the workpiece 1 is translated along the first axis 4 toward the guiding support 5 until that the entire portion of the workpiece 1 to be machined will completely extend from the guiding support 5. The machined workpiece 1 could then be removed from the spindle 5 or cut by the first and/or second abrasive wheel 6, 7 or by a dedicated cutting tool of the grinding machine.

Realisations of elongated workpieces 1 (i.e. length to cross-section ratio typically greater than 100 and even 500) having non-round and/or non-parallel longitudinal contours by known grinding machines and/or methods are known to be subjected to a risk of bending, or even of break, of a free portion of the workpiece. The workpiece bending or break is caused by a lever effect induced by the contact of the abrasive wheel(s) on a free end portion of the workpiece. The risk of a bending, or even to a break, of a free portion of the workpiece is further accentuated in case of machining of workpiece having at least a portion with a small cross-sections (e.g. diameter typically smaller than 1 mm).

In particular by grinding a peripheral portion of the workpiece 1 that extends distally from the guiding support, the proposed solution permits to reduce the risk of a bending/break the workpiece during the machining, providing thus a more economical and efficient realisations of such workpieces, notably of workpieces having one or a plurality of small diameters profiles, with respect to the prior art.

Moreover, in order to further reduce the risk of bend or break a workpiece, the first and the second abrasive wheel 6, 7 can be arranged to rotate in the same rotation direction and move in translation substantially along a same axis 8, (i.e. the third and the fifth axis 62, 72 are substantial coaxial), wherein said axis 8 is substantially perpendicular to the first axis 4 (FIG. 2). The first and the second abrasive wheel 6, 7 can also be arranged to rotate in the opposed rotation directions.

Moreover, the first and the second abrasive wheel 6, 7 can then be arranged to machine the workpiece 1 as near as possible to the guiding support 5, in a simultaneous and continuous way. This solution allows for, during the whole machining operation, to limit the maximal axial distance between each of the two contact portions 105,106 along the first axis 4. This leads to a concentration of the physical forces imposed to the workpiece 1 by the abrasive wheels 6, 7 in a small portions of the peripheral portion 103 as well as to a compensation of the resulting radial vector component of the sum of these physical forces.

The method disclosed herein further allows for, during the whole machining operation, to limit the maximal axial distances between the guiding support 5 and each of these portions 105, 106 along the first axis 4. This leads to a limitation of the maximal distance between the guiding support 5 (acting as fulcrum of the lever) and each the points of application of the grinding forces of abrasive wheels 6, 7.

The method disclosed herein can further reduce the lever effect caused by the abrasive wheels all long the grinding operation, permitting a reliable machining of small, elongated workpieces having one or more portions with small cross sections.

Advantageously during the machining process, the workpiece 1 is translated along the first axis 4 only toward the guiding support 5. The workpiece 1 is thus machined in one passage mode, i.e. in a continuous operation. The method further reduces the machining time with respect to bi-directional passage mode.

In a preferred embodiment, the workpiece 1 is translated along the first axis 4 toward the guiding support 5 in a continuous way all along the machining.

The risk of bend or even break a portion of the workpiece 1 is thus further reduced, notably of an already partially machined portion of the workpiece, permitting a further more reliable machining of small, elongated workpieces having one or more portions with small cross sections.

The method provides a reliable machining of small, elongated workpieces 1 having entirely out-of-centre portions (i.e. portions whose cross-sections are not in contact with the longitudinal central axis of the workpiece 1 to be grinded), as is the case of most non-cylindrical tools, with respect to prior art methods.

Advantageously, the grinding machine and the method disclosed herein can further be arranged so that only the rounded portions 631, 731 of the grinding profile 63, 73 are arranged such as to contact the workpiece 1 in order to limit the contact portions 105, 106 to small and substantially point-shaped contact portions 105, 106. The radius of said rounded portion 631, 731 can be null (sharp edge) or have any suitable value.

The abrasive wheels could be thus arranged so that the flat portions 632,732 are oblique with respect to the first axis 4 in order to avoid an unwanted contact with already machined portion of the workpiece. The flat portions 632, 732 can make a 90° angle with the first axis 4 or any suitable angle.

An advantage of the present method is to provide not only an easy machining of positive sloped longitudinal contour with respect to direction of the grinding (i.e. the axial direction from the guiding support 5 towards the spindle 3), but also to provide an easy machining of negative sloped longitudinal contour with respect to the machining direction.

The present method thus provides a reliable machining of convex portions and concave portions of longitudinal contours of the workpieces.

FIGS. 7-12 show examples of workpieces 1 produced using the present grinding machine and method, wherein the reference 108 indicates the axis of rotation of the workpiece during the machining. The workpieces can be produced in a more economically and reliable way in comparison with known grinding machines and methods.

Figure 7:
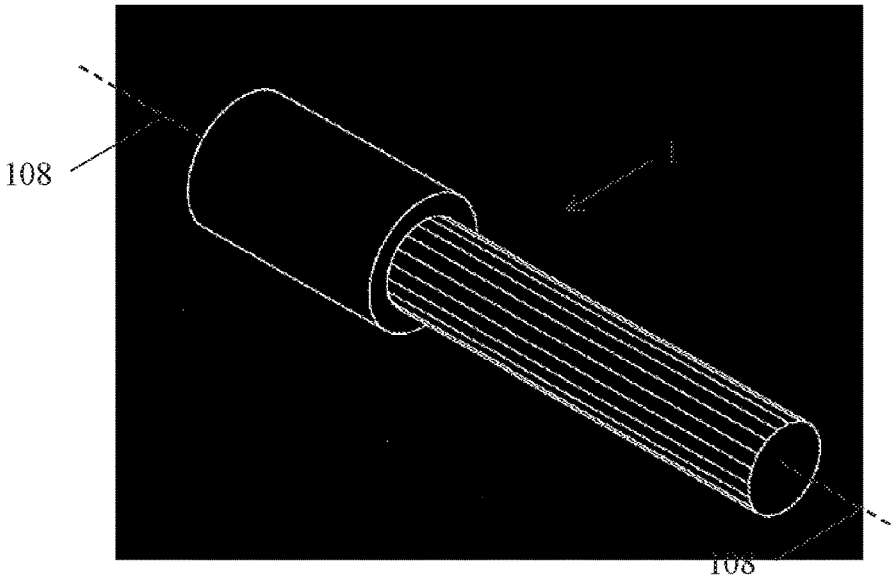
FIGS. 7-14 show some examples of workpieces that could be advantageously realized with the grinding machine and the method of the invention.

In Particular, FIG. 7 shows an example of a workpiece 1 having a terminal portion with a polygonal cross section, i.e. a 20-faced polygonal-shaped terminal portion.

Figure 8:
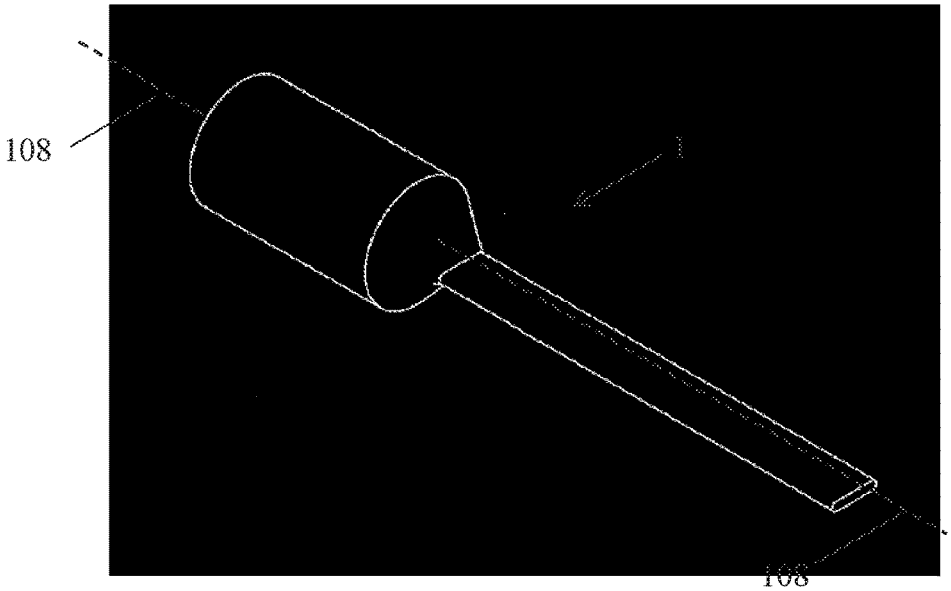
Figure 9:
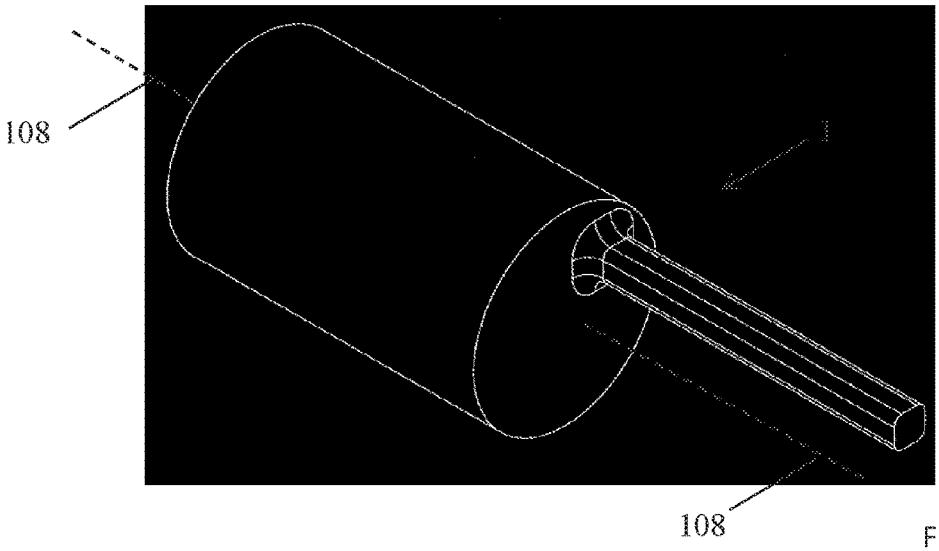
Figure 10:
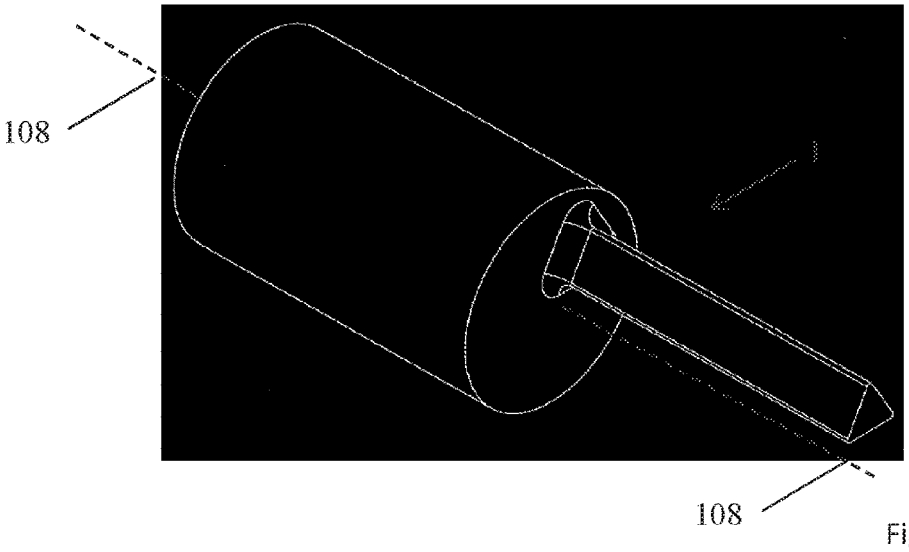

FIGS. 8 to 10 show other examples of grinded workpieces 1 comprising an elongated, single of off-centred portion. The portions can have non-round cross sections, for examples, a rounded rectangular cross section (FIG. 8), a squared cross section (FIG. 9) or a triangular cross section (FIG. 10). Moreover, such portion can have small dimension (for example a cross section smaller than 0.1 mm) and important length-to-cross section ratios, e.g. such as greater than 100 (see FIG. 8).

In contrast with using known methods, the present method allows for produce a grinded workpiece 1 having completely out-of-centre portions, as shown in FIGS. 8 and 9.

Figure 11:
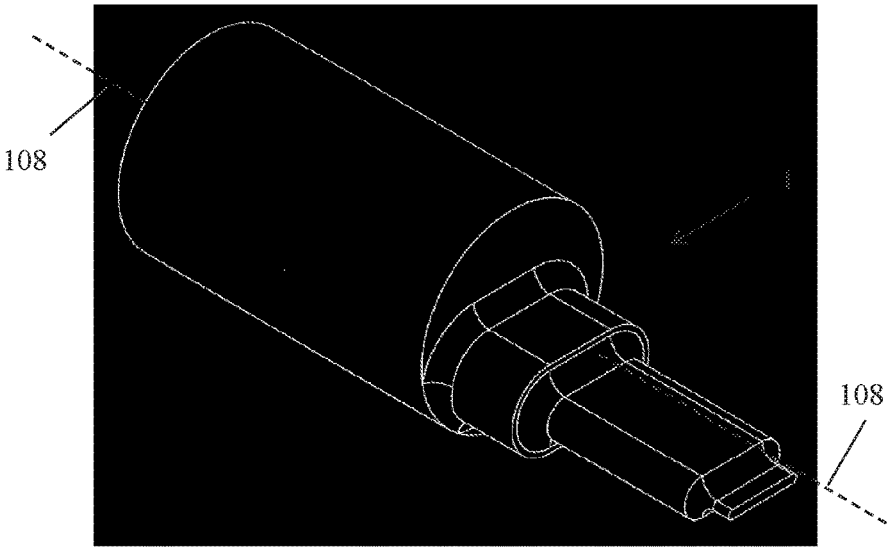
Figure 12:
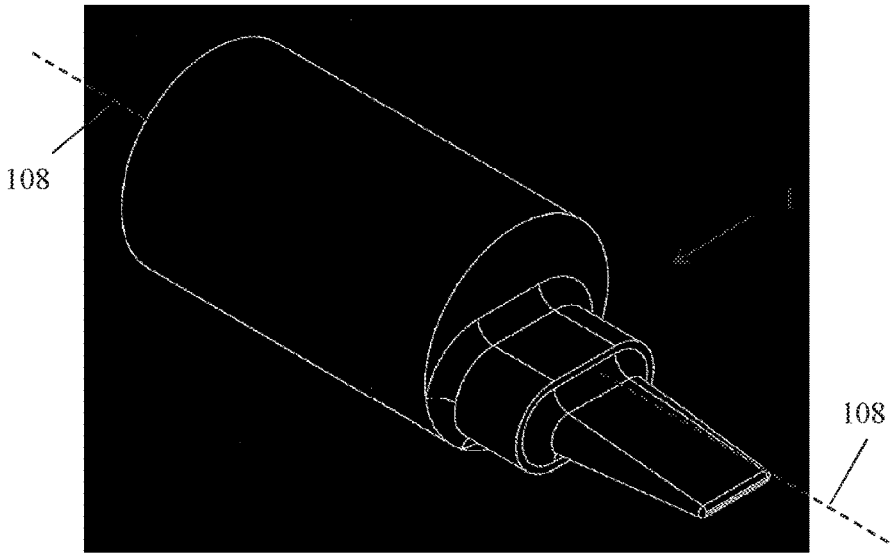
Figure 13:
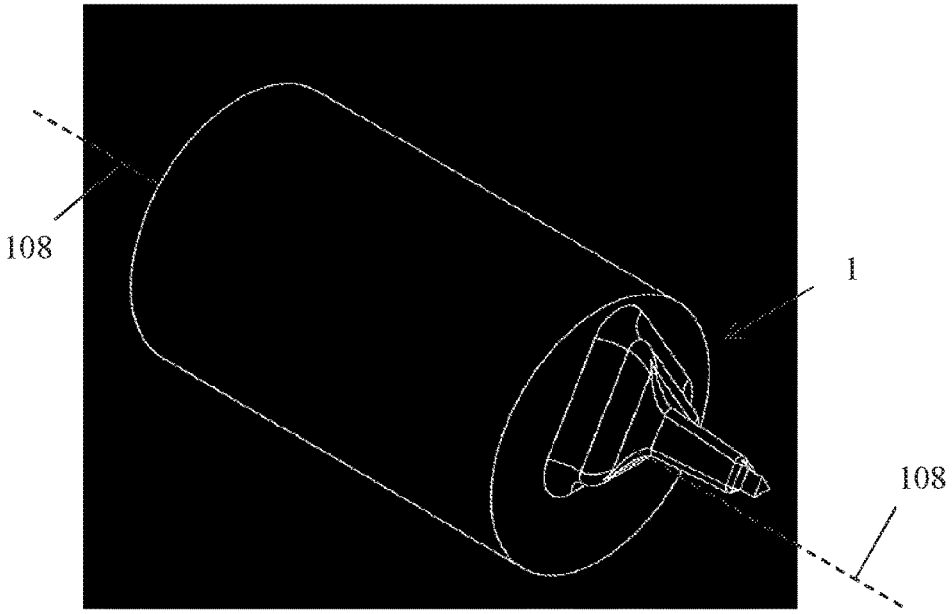

FIGS. 11 to 13 show examples of grinded workpieces 1 comprising a plurality of off-of-center terminal portions.

The off-of-center portions can have small, non-round cross sections, as illustrated in FIGS. 11 and 12.

An advantage of the method disclosed herein is that there is no dimensional limitation in the workpieces being machined. For example, a workpiece being machined with an aspect ratio of about 100 can have dimension in the range of 0.1 mm or in the range of 10 mm or 100 mm, etc.

The profiles of such grinded workpieces 1 can have portions with non-parallel longitudinal contours, e.g. rounded or oblique contours with respect to the longitudinal axe of the (raw) workpiece, as illustrated by the workpiece of FIG. 12.

Figure 14:
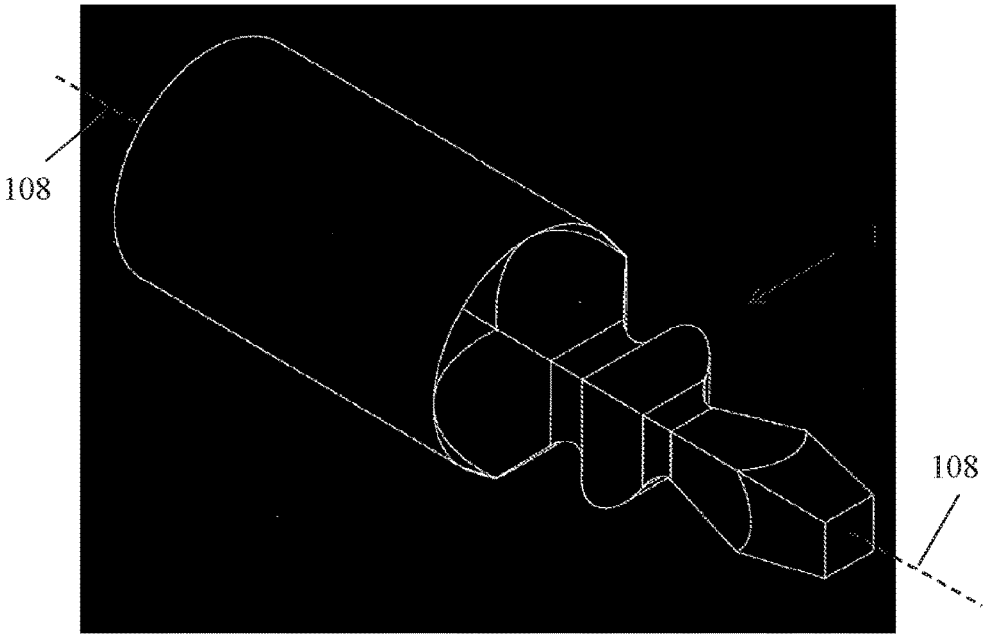

In contrast with known methods, the method of the invention allows for producing workpieces combining non-round portions with convex and concave longitudinal contours as illustrated by FIG. 14.

The method of the invention can produce the grinded workpieces more rapidly and in a more economically and reliable way.

NUMBERED ITEMS

1 Workpiece
101 A first end of the workpiece
102 A second end of the workpiece
103 A peripheral portion of the workpiece
105 Contact surface portion with 1st abrasive wheel
106 Contact surface portion with 2nd abrasive wheel
108 Machining rotational axis
2 Framework of a grinding machine
3 Spindle
4 Rotational and translation axis
5 Guiding support
6 1st abrasive wheel
61 Rotational axis of the 1st abrasive wheel
62 Translation Axis of the 1st abrasive wheel
63 grinding profile of the 1st abrasive wheel
631 Rounded portion
632 Flat portion
7 2nd abrasive wheel
71 Rotational axis of the 2nd abrasive wheel
72 Translation Axis of the 2nd abrasive wheel
73 grinding profile of the 2nd abrasive wheel
731 Rounded portion
732 Flat portion
8 Common grinding axis
9 Headstock
10 Digital control apparatus
S1 Step of grasping the workpiece
S2 Step of positioning the workpiece in a predefined position
S3 Step of rotating and translating the workpiece
S4 Step of determining a position of the workpiece
S5 Step of determining an angular position of the workpiece
S6 Step of selecting a translating speed of the workpiece
S7 Step of selecting a rotational speed of the workpiece
S8 Step of varying a translating speed of the workpiece
S9 Step of varying a rotational speed of the workpiece
S10 Step of positioning an 1st abrasive wheel in a predefined position
S11 Step of rotating and translating the 1st abrasive wheel
S12 Step of translating the 1st abrasive wheel in successive positions
S13 Step of determining a position in translation of the 1st abrasive wheel
S20 Step of positioning a 2nd abrasive wheel in a predefined position
S21 Step of rotating and translating the 2nd abrasive wheel
S22 Step of translating the 2nd abrasive wheel in positions
S23 Step of determining a position in translation of the 2nd abrasive wheel
101 Position of the workpiece
102 Angular position of the workpiece
103 Translation speed of the workpiece
104 Rotational speed of the workpiece
105 Selected translating speed value
106 Selected rotational speed value

The invention claimed is:

1. A method for machining a workpiece by a grinding machine comprising: a spindle arranged for rotating the workpiece around and translated along a first axis, a first abrasive wheel arranged to rotate around a second axis and to translate along a third axis oblique or perpendicular to the second axis, such as to machine a peripheral portion of the workpiece, and a guiding support spaced distally from said spindle along the first axis and arranged for slidingly supporting an end of the workpiece;

the method comprising the step of:

rotating the workpiece around the first axis and translating the workpiece along the first axis toward the guiding support so as to distally extend a portion of the workpiece from the guiding support; and simultaneously rotating the first abrasive wheel around the second axis and translating the first abrasive wheel along the third axis such that the first abrasive wheel machines said peripheral portion of the workpiece;

wherein the first abrasive wheel is translated along the third axis; and wherein a position in translation of the first abrasive wheel along the third axis is determined as a function of a position of the workpiece along the first axis, and an angular position of the workpiece around the first axis.

2. The method according to claim 1, wherein the grinding machine further comprises a second abrasive wheel arranged to rotate around a fourth axis and to translate along a fifth axis oblique or perpendicular to the fourth axis, such as to machine a peripheral portion of the workpiece;

the method further comprising the step of:

rotating the second abrasive wheel around the fourth axis and translating the second abrasive wheel along the fifth axis such that the second abrasive wheel machines a peripheral portion of the workpiece extending distally from the guiding support;

wherein the second abrasive wheel is translated along the fifth axis; and wherein a position in translation of the second abrasive wheel along the fifth axis is determined as a function of a position of the workpiece along the first axis, and an angular position of the workpiece around the first axis.

3. The method according to claim 2, wherein said first abrasive wheel and said second abrasive wheel are arranged to machine substantially the same peripheral portion of the workpiece.

4. The method according to claim 2, wherein the position of the workpiece used for determine the position in translation of the first abrasive wheel along the third axis is the same as the position of the workpiece used for determine the position in translation of the second abrasive wheel along the fifth axis.

5. The method according to claim 2, wherein the angular position of the workpiece used for determine the position in translation of the first abrasive wheel along the third axis is the same as the angular position of the workpiece used for determine the position in translation of the second abrasive wheel along the fifth axis.

6. The method according to claim 2, wherein said first abrasive wheel and said second abrasive wheel are arranged such that the third and the fifth axis are substantial coaxial.

7. The method according to claim 2, wherein said first abrasive wheel and said second abrasive wheel are arranged such that the second and the fourth axis are substantial parallel with respect to the first axis.

8. The method according to claim 3, wherein the workpiece is translated along the first axis toward the guiding support until that the entire portion of the workpiece to be machined extends distally from the guiding support.

9. The method according to claim 1, wherein the workpiece is translated along the first axis only toward the first abrasive wheel.

10. The method according to claim 9, wherein the workpiece is continuously translated along the first axis.

11. The method according to claim 10, wherein the workpiece is translated along the first axis toward the first abrasive wheel at a predefined translation speed or at a variable translation speed.

12. The method according to claim 11, wherein the position in translation of the first abrasive wheel is further determined as a function of said predefined or variable translation speed.

13. The method according to claim 11, wherein a determination of a position in translation of the first abrasive wheel comprises a step of selecting a translation speed of the workpiece.

14. The method according to claim 1, wherein the workpiece is rotated along the first axis at a predefined rotational speed or at a variable rotational speed.

15. The method according to claim 14, wherein the position in translation of the first abrasive wheel is further determined as a function of said predefined or variable rotational speed.

16. The method according to claim 14, wherein a determination of a position in translation of the first abrasive wheel comprises a step of selecting a rotational speed of the workpiece.

17. The method according to claim 1, wherein the third is substantially perpendicular with respect to the first axis.

18. The method according to claim 1, wherein the first abrasive wheel is translated in successive positions in translation along the third axis; wherein each position of the first abrasive wheel is determined as a function of a position of the workpiece along the first axis, and an angular position of the workpiece around the first axis.

19. A grinding machine for carrying out a method for machining a workpiece according to claim 1.

* * * * *